US011116337B2

(12) United States Patent
Alletto, Jr.

(10) Patent No.: US 11,116,337 B2
(45) Date of Patent: Sep. 14, 2021

(54) POWERBAND WITH SHEEN

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 208 days.

(21) Appl. No.: 16/354,964

(22) Filed: Mar. 15, 2019

(65) Prior Publication Data

US 2019/0282005 A1 Sep. 19, 2019

Related U.S. Application Data

(60) Provisional application No. 62/643,835, filed on Mar. 16, 2018.

(51) Int. Cl.

| | |
|---|---|
| ***A47G 9/04*** | (2006.01) |
| ***A47G 9/02*** | (2006.01) |
| ***D02G 3/44*** | (2006.01) |

(52) U.S. Cl.

CPC ..... *A47G 9/04* (2013.01); *A47G 9/0253* (2013.01); *D02G 3/44* (2013.01); *D10B 2331/02* (2013.01); *D10B 2331/04* (2013.01); *D10B 2401/20* (2013.01); *D10B 2503/06* (2013.01)

(58) Field of Classification Search

CPC .... A47G 9/04; A47G 9/10; A47G 2009/1018; A47G 9/1036; A47G /

See application file for complete search history.

(56) References Cited

U.S. PATENT DOCUMENTS

| | | | | |
|---|---|---|---|---|
| 2,357,789 | A | 9/1944 | Levy | |
| 3,737,505 | A * | 6/1973 | Turner et al. | D01D 5/253 264/177.13 |
| 5,479,664 | A * | 1/1996 | Hollander | A47G 9/0246 5/497 |
| 6,067,677 | A * | 5/2000 | Reen | A47G 9/0246 5/496 |
| 6,305,196 | B1 * | 10/2001 | Takeshita | D04B 21/10 66/195 |
| 2010/0102100 | A1 | 4/2010 | Hickey et al. | |
| 2012/0266753 | A1 | 10/2012 | Woolfson et al. | |

FOREIGN PATENT DOCUMENTS

| | | | |
|---|---|---|---|
| CH | 503485 | A | 2/1971 |
| EP | 0270014 | A2 | 6/1988 |
| FR | 2884697 | A1 | 10/2006 |
| GB | 289027 | A | 1/1929 |
| WO | 2018200485 | A1 | 11/2018 |

OTHER PUBLICATIONS

International Search Report and Written Opinion of the International Searching Authority, European Patent Office, PCT/US2019/022506, dated Jun. 21, 2019.

* cited by examiner

*Primary Examiner* — Fredrick C Conley
(74) *Attorney, Agent, or Firm* — Sorell, Lenna & Schmidt, LLP

(57) ABSTRACT

A pillowcase includes a top panel and an opposite bottom panel. The top panel has three sides that are joined with three sides of the bottom panel such that inner surfaces of the top and bottom panels that face one another define a cavity configured for disposal of a pillow. Fourth sides of the top and bottom panels are not joined with one another and define an opening that is in communication with the cavity. A power band extends across the opening. The power band includes a sheen.

20 Claims, 11 Drawing Sheets

POWERBAND WITH SHEEN

TECHNICAL FIELD

The present disclosure generally relates to bedding, and more particularly to pillowcases configured for disposal of a pillow in a manner that prevents the pillow from slipping out of the pillow case unintentionally.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable, in order to achieve restful sleep.

Typically, pillowcases are cavities having an opening in one end to insert and/or remove a pillow from the cavity. However, factors such as, for example, size, shape, material, etc. of the pillow and/or pillowcase may cause the pillow to slip out of the pillowcase unintentionally when the user is asleep and/or may cause the pillow to shift within the pillowcase, for example. That is, the pillowcases lack any structural element that could function to prevent the pillow from slipping out of the pillowcase unintentionally and/or prevent the pillow from shifting within the pillowcase. This disclosure describes an improvement over these prior art technologies.

SUMMARY

In one embodiment, in accordance with the principles of the present disclosure, a pillowcase is provided. The pillowcase includes a top panel and an opposite bottom panel. The top panel has three sides that are joined with three sides of the bottom panel such that inner surfaces of the top and bottom panels that face one another define a cavity configured for disposal of a pillow. Fourth sides of the top and bottom panels are not joined with one another and define an opening that is in communication with the cavity. A power band extends across the opening. The power band includes a sheen namely a shine, luster, gloss, polish, brilliance or radiance that is soft to the touch.

In one embodiment, the pillowcase includes one or a plurality of power bands within the cavity that function to hold a pillow within the cavity and/or prevent the pillow from shifting within the pillowcase. That is, the power band(s) will hold the pillow within the cavity to prevent the pillow from slipping out of the cavity unintentionally and/or prevent the pillow from shifting within the pillowcase as a user sleeps. In some embodiments, the pillowcase includes only one power band. In some embodiments, the pillowcase includes a plurality of power bands. In some embodiments, the power bands are spaced apart from one another. In some embodiments, the power bands each engage the inner surface of the top panel and the inner surface of the bottom panel such that the power bands each extend across the opening. In some embodiments, the power bands only partially block the opening. In some embodiments, the power bands completely block the opening. In some embodiments, the power bands are biased to a closed position in which the power bands overlap one another. The power bands are moved away from one another to move the power bands from the closed position to an open position. When the power bands are in the open position, a pillow may be positioned between the power bands and pushed into the cavity. Once the power bands are released, they will move from the open position to the closed position to maintain the pillow within the cavity.

In one embodiment, in accordance with the principles of the present disclosure, a bedding system is provided. The bedding system includes a pillow and a pillowcase comprising a top panel and an opposite bottom panel. The top panel has three sides that are joined with three sides of the bottom panel such that inner surfaces of the top and bottom panels that face one another define a cavity configured for disposal of the pillow. Fourth sides of the top and bottom panels are not joined with one another and define an opening that is in communication with the cavity. A power band that extends across the opening. The power band includes a sheen.

In one embodiment, in accordance with the principles of the present disclosure, a pillowcase is provided. The pillowcase includes a top panel and an opposite bottom panel. The top panel has three sides that are joined with three sides of the bottom panel such that inner surfaces of the top and bottom panels that face one another define a cavity configured for disposal of a pillow. Fourth sides of the top and bottom panels are not joined with one another and define an opening that is in communication with the cavity. A power band extends across the opening. The power band includes a sheen. The power band comprises nylon, polyester and spandex.

In one embodiment, in accordance with the principles of the present disclosure, a bedding system is provided. The bedding system includes a pillow and a pillowcase comprising a top panel and an opposite bottom panel. The top panel has three sides that are joined with three sides of the bottom panel such that inner surfaces of the top and bottom panels that face one another define a cavity having the pillow disposed therein. Fourth sides of the top and bottom panels are not joined with one another and define an opening that is in communication with the cavity. Spaced apart first and second power bands each extend across the opening to prevent the pillow from slipping out of the pillowcase unintentionally and/or to prevent the pillow from shifting within the cavity. The power bands each include a sheen. The power band each comprise nylon, polyester and spandex.

In some embodiments, the pillowcase can include one or a plurality of power bands. In some embodiments, at least one of the power bands comprises an iridescent yarn to provide the sheen. In some embodiments, at least one of the power bands comprises a top surface and an opposite bottom surface, the top surface comprising an iridescent yarn to provide the sheen, the bottom surface defining a textured surface. In some embodiments, at least one of the power bands comprises a top surface an opposite bottom surface, the top surface comprising an iridescent yarn to provide the sheen, the top surface being smooth, the bottom surface defining a textured surface.

In some embodiments, at least one of the power bands comprises a material having a weight per meter of between about 10G and about 30G. In some embodiments, at least one of the power bands comprises a material having a weight per meter of between about 20G and about 35G. In some embodiments, at least one of the power bands comprises a material having a weight per meter of 23.25 G.

In some embodiments, at least one of the power bands comprises a material having a dimensional stability of between about 0% and about −10%. In some embodiments, at least one of the power bands comprises a material having a dimensional stability of between about −2.5% and about −7.5%. In some embodiments, at least one of the power bands comprises a material having a dimensional stability of −5%.

In some embodiments, at least one of the power bands comprises a woven material. In some embodiments, at least one of the power bands comprises a reinforced jacquard knit fabric. In some embodiments, at least one of the power bands comprises an elastic material. In some embodiments, at least one of the power bands comprises polyester and latex. In some embodiments, at least one of the power bands comprises between about 1% and about 50% latex and between about 50% and about 99% polyester. In some embodiments, at least one of the power bands comprises between about 15% and about 40% latex and between about 60% and about 85% polyester. In some embodiments, at least one of the power bands comprises between about 20% and about 30% latex and between about 70% and about 80% polyester. In some embodiments, at least one of the power bands comprises 26% latex and 74% polyester.

In some embodiments, at least one of the power bands comprises polyester having a Denier (D) between about 100D and about 200D and yarn size containing between about 30 filaments and about 60 filaments. In some embodiments, at least one of the power bands comprises polyester having a Denier (D) between about 125D and about 175D and yarn size containing between about 40 filaments and about 50 filaments. In some embodiments, at least one of the power bands comprises polyester having a 175 Denier and yarn size containing 48 filaments.

In some embodiments, at least one of the power bands comprises a material having an elongation of about 100% to about 200% at a load of 5.25 kgf. In some embodiments, at least one of the power bands comprises a material having an elongation of about 125% to about 175% at a load of 5.25 kgf. In some embodiments, at least one of the power bands comprises a material having an elongation of 150% at a load of 5.25 kgf.

In some embodiments, the power band is recessed inwardly from the opening. In some embodiments, the power band is stitched inside a hem of the pillowcase.

BRIEF DESCRIPTION OF THE DRAWINGS

The present disclosure will become more readily apparent from the specific description accompanied by the following drawings, in which.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" or "top" and "bottom" are relative and used only in the context to the other, and are not necessarily "superior" and "inferior".

The following discussion includes a description of bed sheets and pillow cases in accordance with the principles of the present disclosure. Alternate embodiments are also disclosed. Reference will now be made in detail to the exemplary embodiments of the present disclosure, which are illustrated in the accompanying figures. Turning to FIGS. 1-10B, there are illustrated a bedding system 20.

Figure 1:
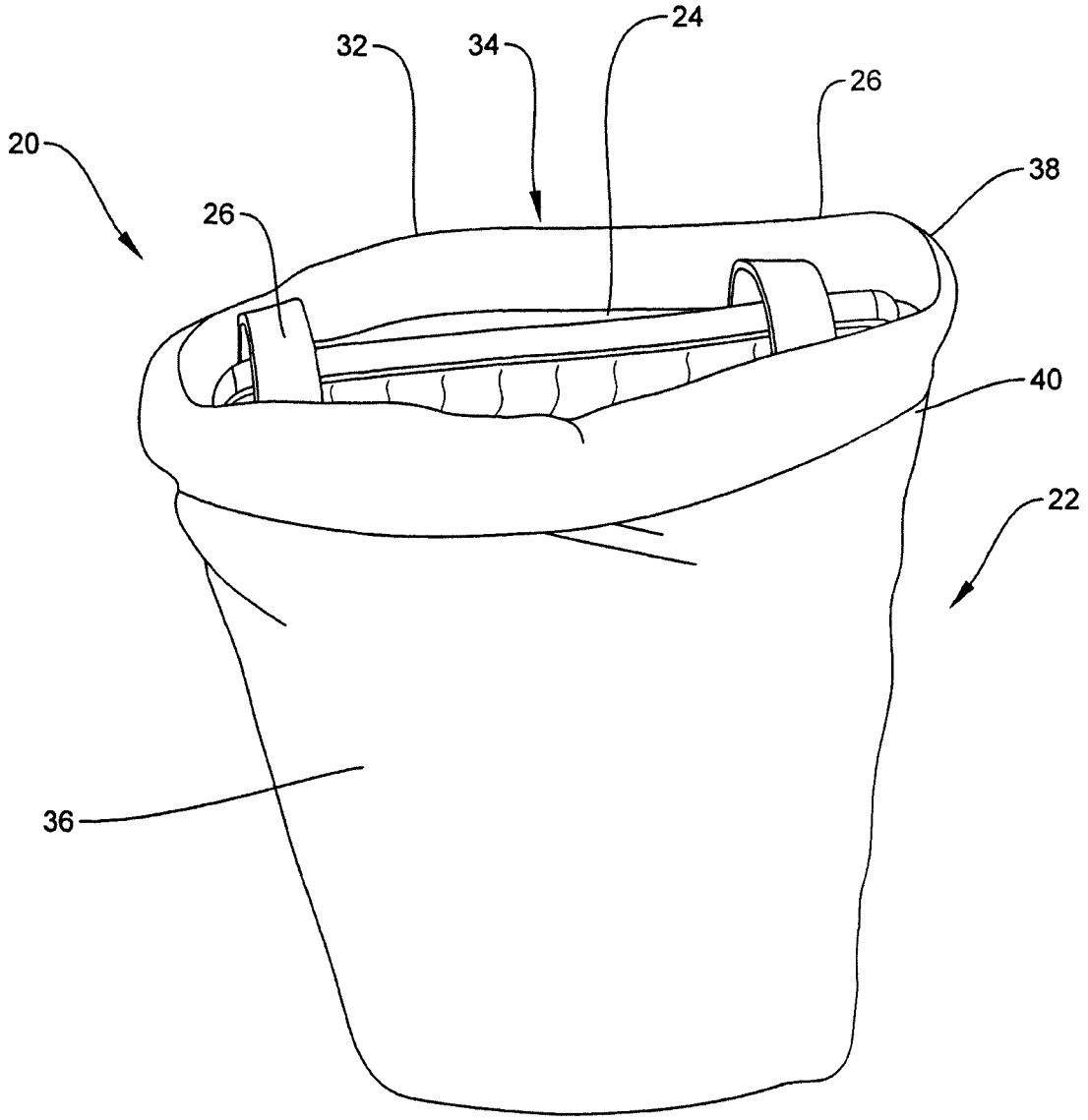
FIG. 1 is a perspective view of a bedding system in accordance with the principles of the present disclosure.

Bedding system 20 includes one or a plurality of pillowcases 22 and may include one or a plurality of pillows 24, wherein each of pillows 24 is configured for disposal in one of pillowcases 22, as shown in FIG. 1. Pillowcases 22 each include at least one power band 26 configured to prevent pillow 24 from slipping out of pillowcase 22 unintentionally and/or prevent pillow 24 from shifting within pillowcase 22 as a user sleeps, as discussed herein. In some embodiments, power bands 26 are made from an elastic material. In some embodiments, power bands 26 are made from an inelastic material.

Figure 2:
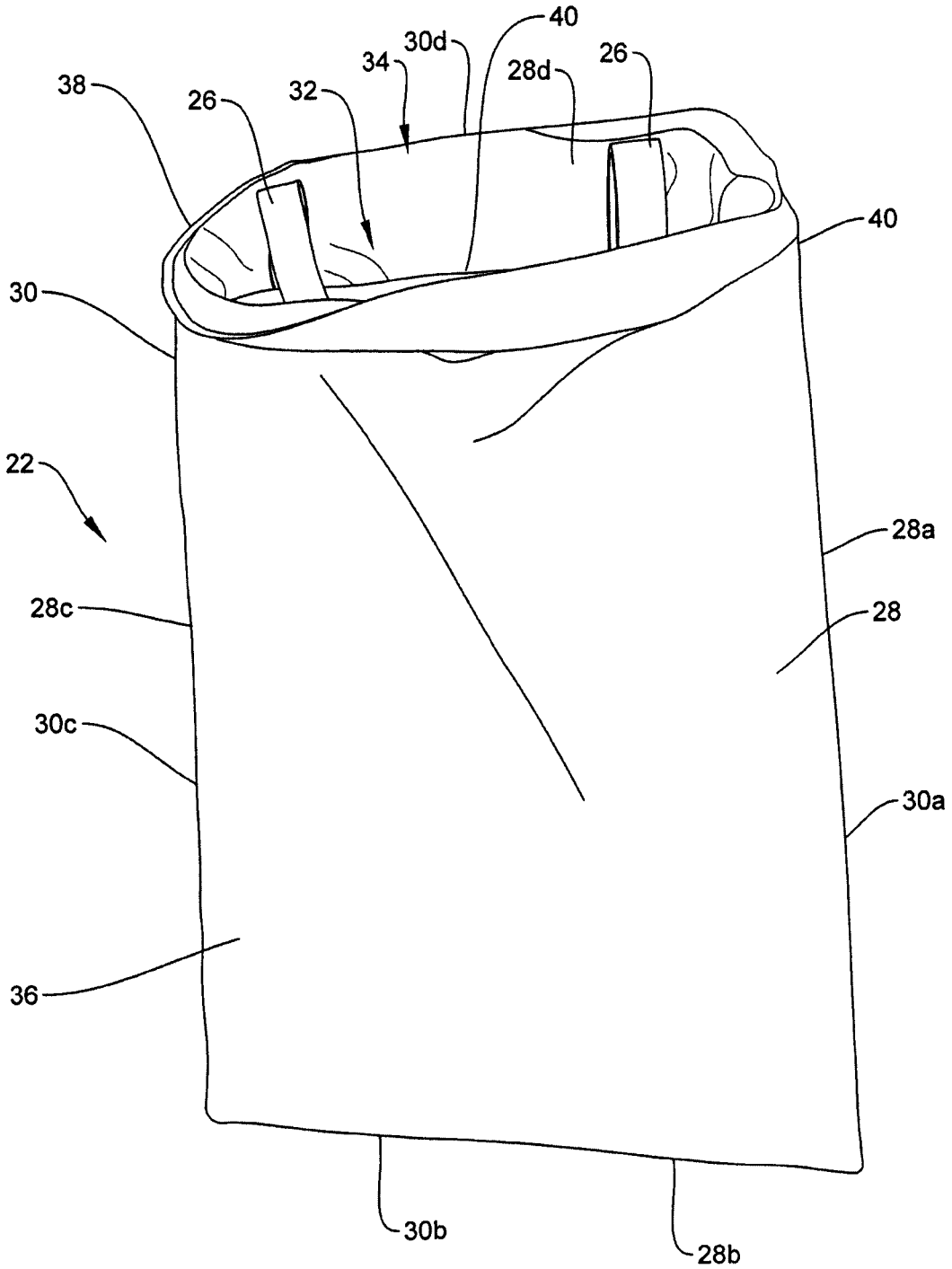
FIG. 2 is a perspective view of a component of the bedding system shown in FIG. 1.

Pillowcase 22 includes opposite top and bottom panels 28, 30. Inner surfaces of top and bottom panels 28, 30 face one another and define a cavity 32 configured for disposal of a pillow, such as, for example, pillow 24. Top panel 28 is substantially rectangular and includes edges, such as, for example, sides 28*a*, 28*b*, 28*c*, 28*d* that define a perimeter of top panel 28, as shown in FIG. 2. Bottom panel 30 is substantially rectangular and includes edges, such as, for example, sides 30*a*, 30*b*, 30*c*, 30*d* that define a perimeter of bottom panel 30, as also shown in FIG. 2. Side 28*a* is joined with side 30*a*; side 28*b* is joined with side 30*b*; and side 28*c* is joined with side 30*c*, as shown in FIG. 2. The sides of top panel 28 may be joined with the sides of bottom panel 30 by stitching, for example. Side 28*d* is not joined with side 30*d* such that sides 28*d*, 30*d* define an opening 34 that is communication with cavity 32. A pillow, such as, for example, pillow 24 is configured to be positioned through opening 34 for disposal in cavity 32. In some embodiments, top panel 28 and/or bottom panel 30 is variously shaped, such as, for example, circular, oval, oblong, triangular, square, polygonal, irregular, uniform, non-uniform, undulating, arcuate, variable and/or tapered.

In one embodiment, shown in FIGS. 1 and 2, pillowcase 22 includes two power bands 26 that are spaced apart from one another. Power bands 26 each include a first end that directly engages the inner surface of top panel 28 and an opposite second end that directly engages the inner surface of bottom panel 30 such that power bands 26 each extend across opening 34 to prevent pillow 24 from slipping out of cavity 32 and/or prevent pillow 24 from shifting within cavity 32, as can be seen in FIG. 1. Power bands 26 are each planar strips of material. In some embodiments, power bands 26 extend parallel to one another across opening 34. In some embodiments, power bands 26 may be disposed at alternate orientations, relative to one another, such as, for example, transverse, perpendicular and/or other angular orientations such as acute or obtuse, and/or may be offset or staggered.

Pillowcase 22 includes a body portion 36 and a cuff 38 that is coupled to body portion 36 by stitching 40. Cuff 38 defines opening 34. In some embodiments, stitching 40 extends continuously about an entire diameter of pillowcase 22. In some embodiments, stitching 40 may include piping or other features to reinforce stitching 40 and/or provide an improved appearance. In the embodiment shown in FIGS. 1 and 2, the first ends of power bands 26 are coupled to the inner surface of top panel 28 at stitching 40 and the second ends of power bands 26 are coupled to the inner surface of bottom surface 30 at stitching 40. It is envisioned that attaching power bands 26 to pillowcase 22 at stitching 40 will provide durability that will prevent power bands 26 from ripping pillowcase 22 when one or more of power bands is pulled or otherwise manipulated. In some embodiments, power bands 26 are attached to pillowcase 22 by stitching that goes directly over stitching 40.

In operation and use, power bands 26 are moved in opposite directions to increase the maximum distance between power bands 26. A first end of a pillow, such as, for example, one of pillows 24 is positioned through opening 34 such that the first end of pillow 24 is positioned between power bands 26. Pillow 24 is then pushed into cavity 32 such that the first end of pillow 24 is positioned adjacent to sides 28*b*, 30*b* of top and bottom panels 28, 30. The force that was applied to power bands 26 to increase the maximum distance between power bands 26 may be removed to allow the maximum distance between power bands 26 to decrease such that power bands 26 engage an opposite second end of pillow 24, as shown in FIG. 1.

Figure 3:
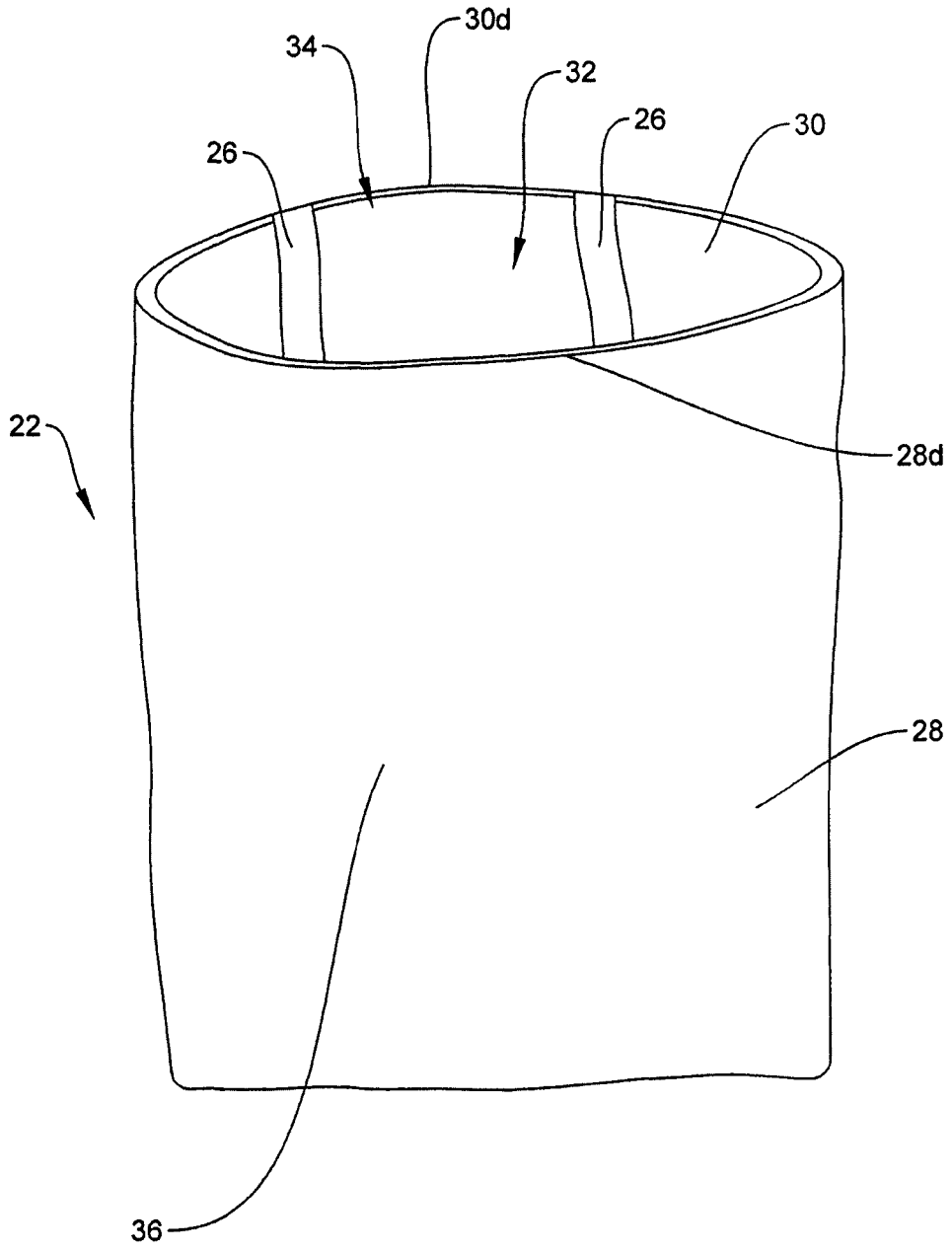
FIG. 3 is a perspective view of one embodiment of a component of the system shown in FIG. 1, in accordance with the principles of the present disclosure.

In one embodiment, shown in FIG. 3, pillowcase 22 includes body portion 36, but does not include a cuff, such as, for example, cuff 38 in the embodiment shown in FIGS. 1 and 2. In this embodiment, sides or edges 28*d*, 30*d* define opening 34. Pillowcase 22 includes two power bands 26 that are spaced apart from one another. Power bands 26 each include a first end that directly engages edge 28*d* of top panel 28 and an opposite second end that directly engages edge 30*d* of bottom panel 30 such that power bands 26 each extend across opening 34 to prevent pillow 24 from slipping out of cavity 32 and/or prevent pillow 24 from shifting within cavity 32. Power bands 26 are each planar strips of material. In some embodiments, power bands 26 extend parallel to one another across opening 34. In some embodiments, power bands 26 may be disposed at alternate orientations, relative to one another, such as, for example, transverse, perpendicular and/or other angular orientations such as acute or obtuse, and/or may be offset or staggered.

In operation and use, power bands 26 are moved in opposite directions to increase the maximum distance between power bands 26. A first end of a pillow, such as, for example, one of pillows 24 is positioned through opening 34 such that the first end of pillow 24 is positioned between power bands 26. Pillow 24 is then pushed into cavity 32 such that the first end of pillow 24 is positioned adjacent to sides 28*b*, 30*b* of top and bottom panels 28, 30. The force that was applied to power bands 26 to increase the maximum distance between power bands 26 may be removed to allow the maximum distance between power bands 26 to decrease such that power bands 26 engage an opposite second end of pillow 24.

Figure 4:
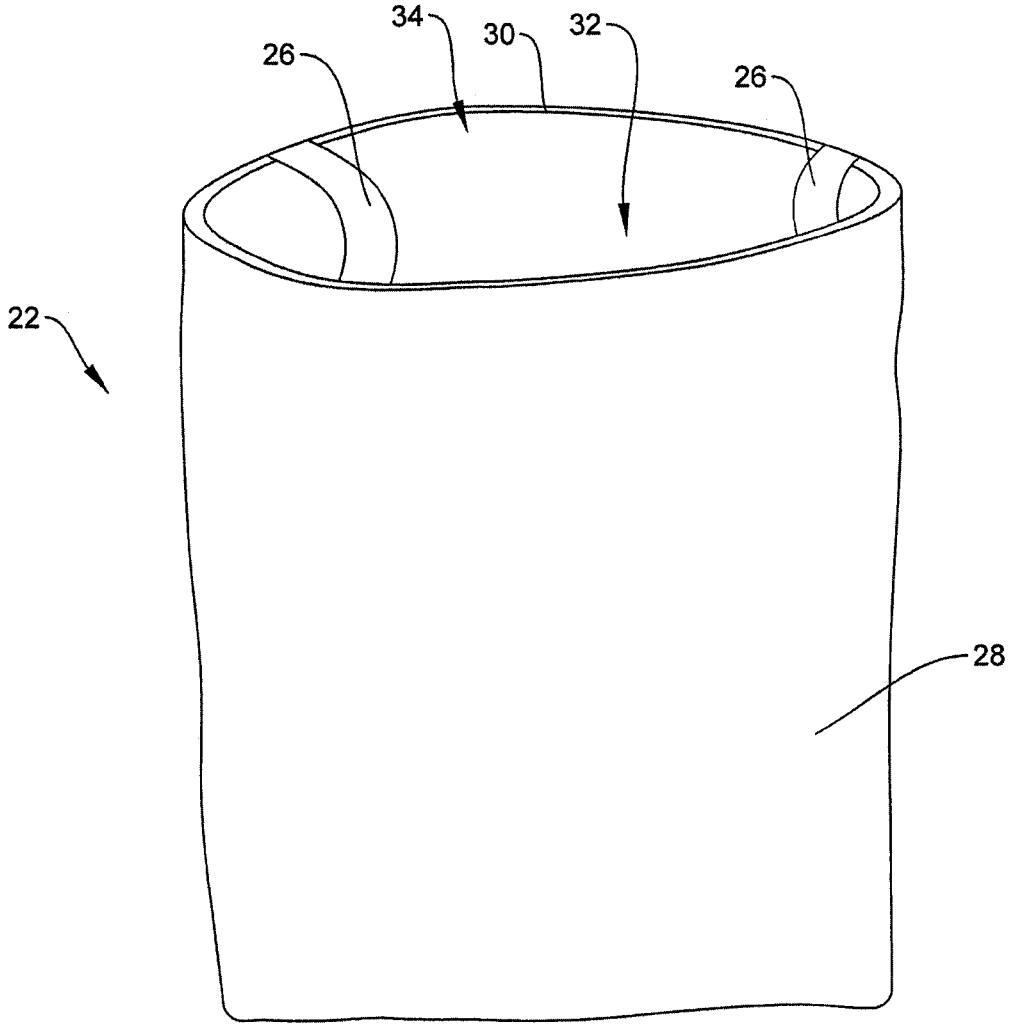
FIG. 4 is a perspective view of one embodiment of a component of the system shown in FIG. 1, in accordance with the principles of the present disclosure.

In one embodiment, shown in FIG. 4, pillowcase 22 includes two power bands 26 that are spaced apart from one another. Power bands 26 each include a first end that directly engages top panel 28 and an opposite second end that directly engages bottom panel 30 such that power bands 26 each extend across opening 34 to prevent pillow 24 from slipping out of cavity 32 and/or prevent pillow 24 from shifting within cavity 32. Power bands 26 are each curved between the first end and the second end of power band 36. As shown in FIG. 4, power bands 26 are each curved toward the other one of power bands 26.

Pillowcase 22 shown in FIG. 4 can include a body portion, such as, for example, body portion 36 and a cuff, such as, for example, cuff 38 in the embodiment shown in FIGS. 1 and 2. Similar to the embodiment shown in FIGS. 1 and 2, the body portion may be joined with the cuff by stitching, such as, for example, stitching 40. In such embodiments, the first ends of power bands 26 are coupled to the inner surface of top panel 28 at stitching that joins 40 the cuff with the body portion and the second ends of power bands 26 are coupled to the inner surface of bottom surface 30 at the stitching that joins 40 the cuff with the body portion.

Pillowcase 22 shown in FIG. 4 can include a body portion, such as, for example, body portion 36, but does not include a cuff, such as, for example, cuff 38 in the embodiment shown in FIGS. 1 and 2. Power bands 26 each include a first end that directly engages edge 28*d* of top panel 28 and an opposite second end that directly engages edge 30*d* of bottom panel 30 such that power bands 26 each extend across opening 34 to prevent pillow 24 from slipping out of cavity 32 and/or prevent pillow 24 from shifting within cavity 32.

In operation and use, power bands 26 are moved in opposite directions to increase the maximum distance between power bands 26. A first end of a pillow, such as, for example, one of pillows 24 is positioned through opening 34 such that the first end of pillow 24 is positioned between power bands 26. Pillow 24 is then pushed into cavity 32 such that the first end of pillow 24 is positioned adjacent to sides 28*b*, 30*b* of top and bottom panels 28, 30. The force that was applied to power bands 26 to increase the maximum distance between power bands 26 may be removed to allow the maximum distance between power bands 26 to decrease such that power bands 26 engage an opposite second end of pillow 24, as shown in FIG. 1.

Figure 5:
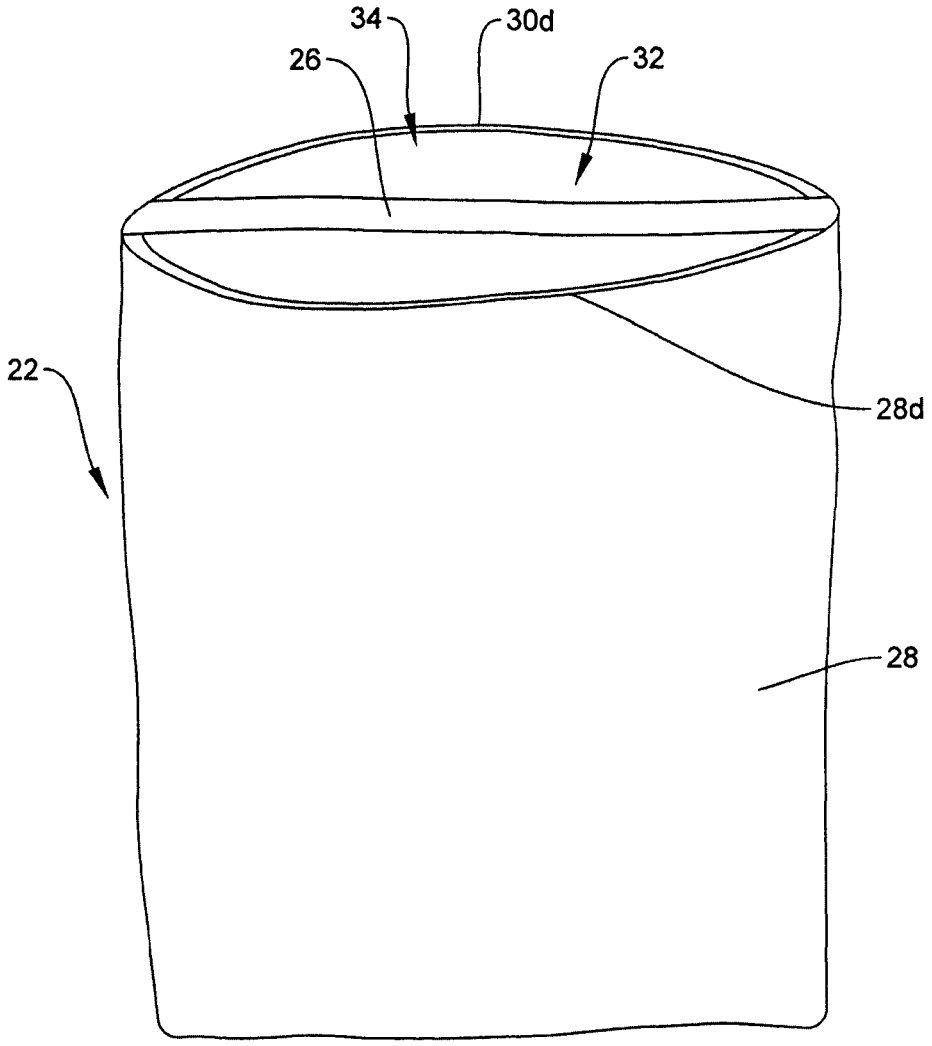
FIG. 5 is a perspective view of one embodiment of a component of the system shown in FIG. 1, in accordance with the principles of the present disclosure.

In one embodiment, shown in FIG. 5, pillowcase 22 includes only one power band 26. Power band 26 includes a first end that directly engages top panel 28 and an opposite second end that directly engages bottom panel 30 such that power band 26 extends across opening 34 to prevent pillow 24 from slipping out of cavity 32 and/or prevent pillow 24 from shifting within cavity 32. In particular, the first end of power band 26 may be coupled to an interface of sides 28*a*, 30*a* and the second end of power band 26 may be coupled to an interface of sides 28*c*, 30*c*. In some embodiments, the first end of power band 26 is stitched to stitching that joins sides 28*a*, 30*a* and the second end of power band 26 is stitched to stitching that includes sides 28*c*, 30*c*.

Pillowcase 22 shown in FIG. 5 can include a body portion, such as, for example, body portion 36 and a cuff, such as, for example, cuff 38 in the embodiment shown in FIGS. 1 and 2. Similar to the embodiment shown in FIGS. 1 and 2, the body portion may be joined with the cuff by stitching, such as, for example, stitching 40. In such embodiments, power band 26 is recessed inwardly of sides or edges 28*d*, 30*d*.

Pillowcase 22 shown in FIG. 5 can include a body portion, such as, for example, body portion 36, but does not include a cuff, such as, for example, cuff 38 in the embodiment shown in FIGS. 1 and 2. In such embodiments, power band 26 is flush with edges 28*d*, 30*d*.

In operation and use, power band 26 may be moved toward edge 28*d* to increase the maximum distance between power band 26 and edge 30*d*. A first end of a pillow, such as, for example, one of pillows 24 is positioned between edge 30*d* and power band 26. Pillow 24 is then pushed into cavity 32 such that the first end of pillow 24 is positioned adjacent to sides 28*b*, 30*b* of top and bottom panels 28, 30. The force that was applied to power band 26 to move power band 26 toward edge 28*d* may be removed to decrease the distance between power band 26 and edge 30*d* such that power band 26 engages an opposite second end of pillow 24. Alternatively, power band 26 may be moved toward edge 30*d* to increase the maximum distance between power band 26 and edge 28*d*. A first end of a pillow, such as, for example, one of pillows 24 is positioned between edge 28*d* and power band 26. Pillow 24 is then pushed into cavity 32 such that the first end of pillow 24 is positioned adjacent to sides 28*b*, 30*b* of top and bottom panels 28, 30. The force that was applied to power band 26 to move power band 26 toward edge 30*d* may be removed to decrease the distance between power band 26 and edge 28*d* such that power band 26 engages an opposite second end of pillow 24.

Figure 6:
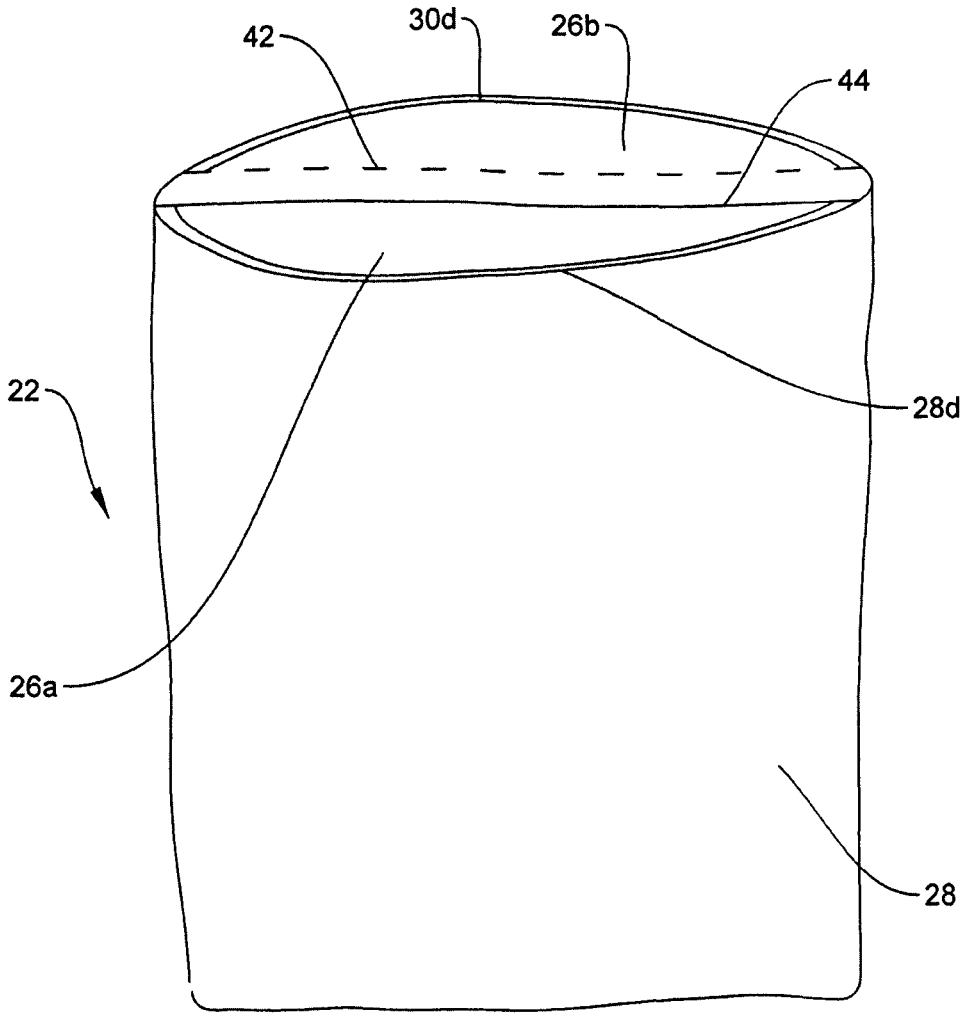
FIG. 6 is a perspective view, in part phantom, of one embodiment of a component of the system shown in FIG. 1, in accordance with the principles of the present disclosure.
Figure 7:
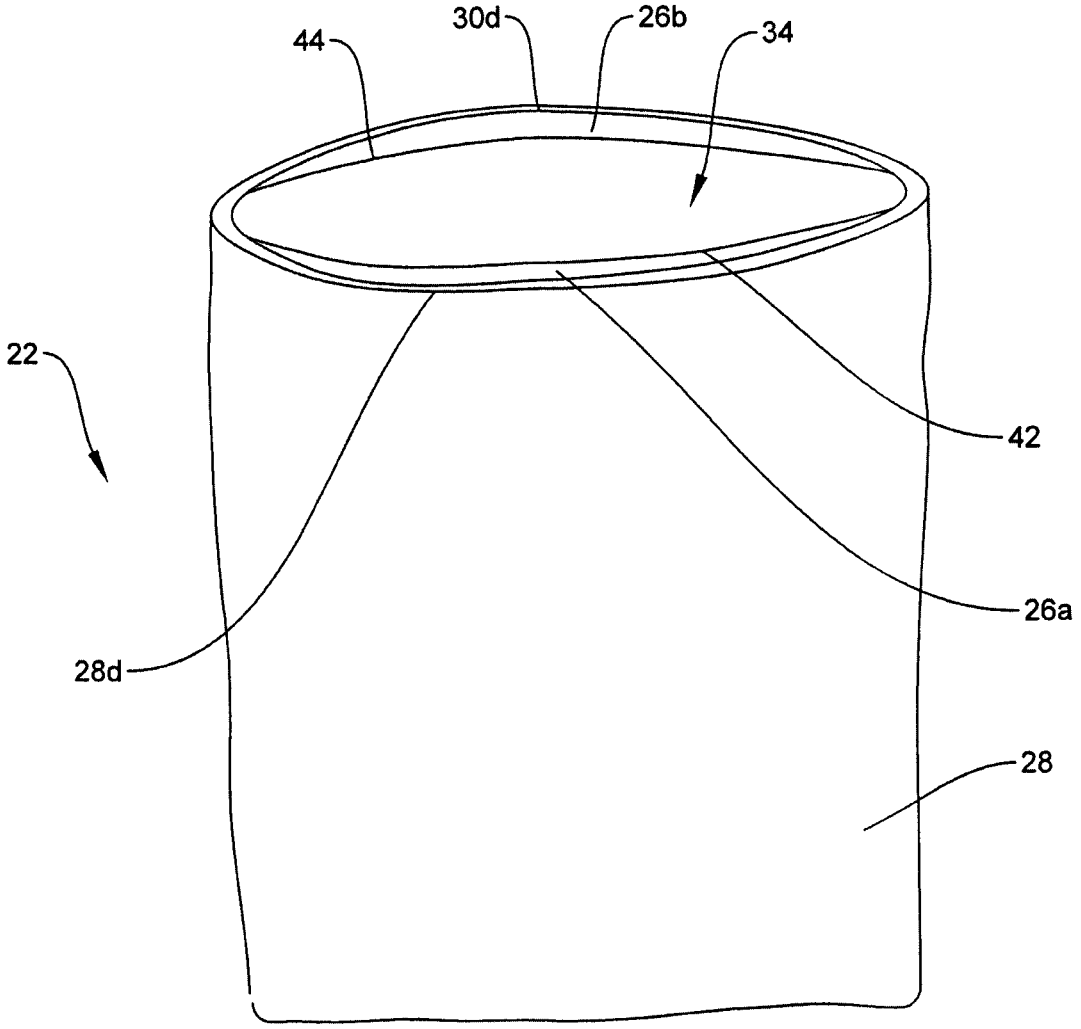
FIG. 7 is a perspective view of the component shown in FIG. 6.

In one embodiment, shown in FIGS. 6 and 7, pillowcase 22 includes a first power band 26*a* that extends along edge 28*d* and a second power band 26*b* that extends along edge 30*d*. First power band 26*a* is positioned relative to second power band 26*b* such that an end surface 42 of first power band 26*a* overlaps an end surface 44 of second power band 26*b*. In some embodiments, first power band 26*a* extends continuously along the entire length of edge 28*d* and second power band 26*b* extends continuously along the entire length of edge 30*d*. First and second power bands 26*a*, 26*b* are movable relative to one another between a closed configuration in which end surface 42 overlaps end surface 44 to close opening 34, as shown in FIG. 6, and an open configuration in which end surface 42 is spaced apart from end surface 44 to define opening 34 therebetween, as shown in FIG. 7. In some embodiments, power bands 26*a*, 26*b* are biased to the closed configuration.

In operation and use, power bands 26*a*, 26*b* are moved in opposite directions to move power bands 26*a*, 26*b* from the closed configuration to the open configuration and space power bands 26*a*, 26*b* apart such that end surfaces 42, 44 of power bands 26*a*, 26*b* define opening 34. A first end of a pillow, such as, for example, one of pillows 24 is positioned through opening 34 such that the first end of pillow 24 is positioned between power bands 26. Pillow 24 is then pushed into cavity 32 such that the first end of pillow 24 is positioned adjacent to sides 28*b*, 30*b* of top and bottom panels 28, 30. The force that was applied to power bands 26*a*, 26*b* to space power bands 26*a*, 26*b* apart may be removed to move power bands 26*a*, 26*b* from the open configuration shown in FIG. 7 to the closed configuration shown in FIG. 6.

Figure 10:
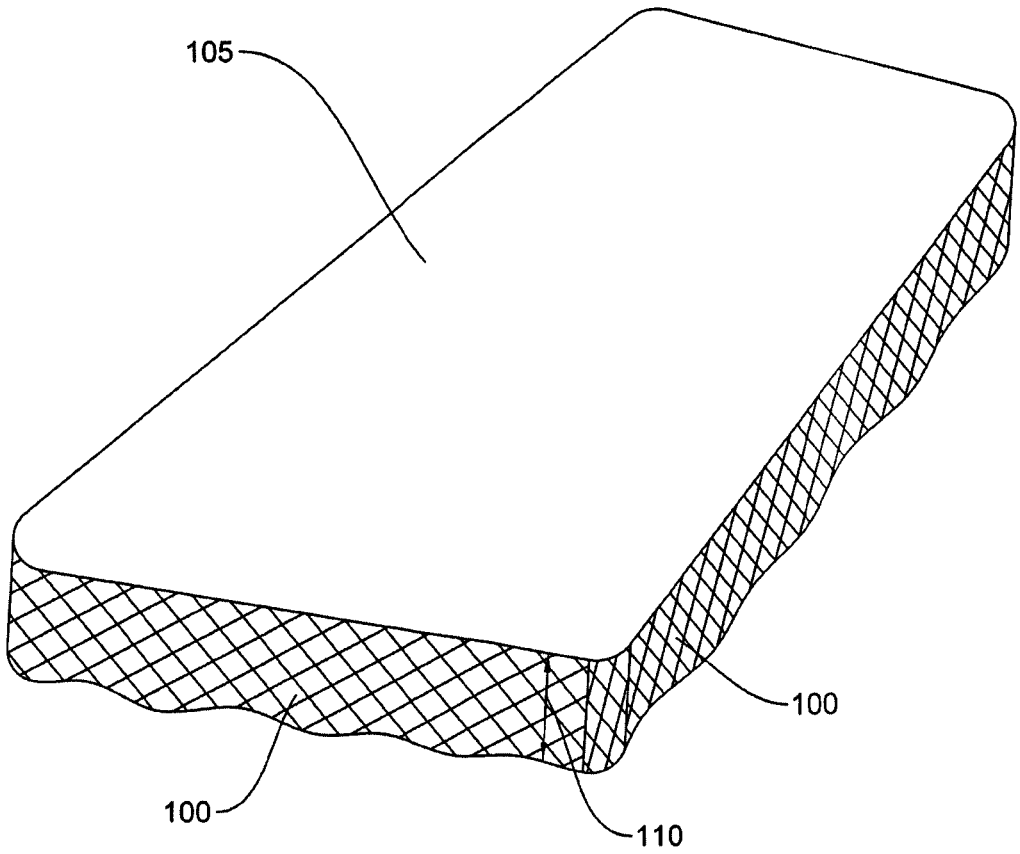
FIG. 10 is a perspective view of a sheet having the power band.
Figure 10A:
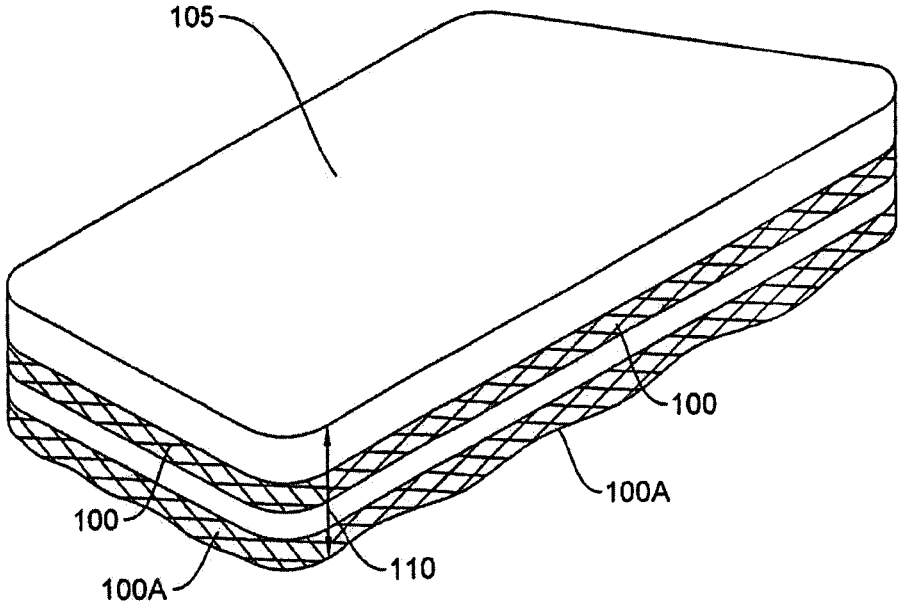
FIG. 10A is a perspective view of a sheet having multiple power bands.
Figure 10B:
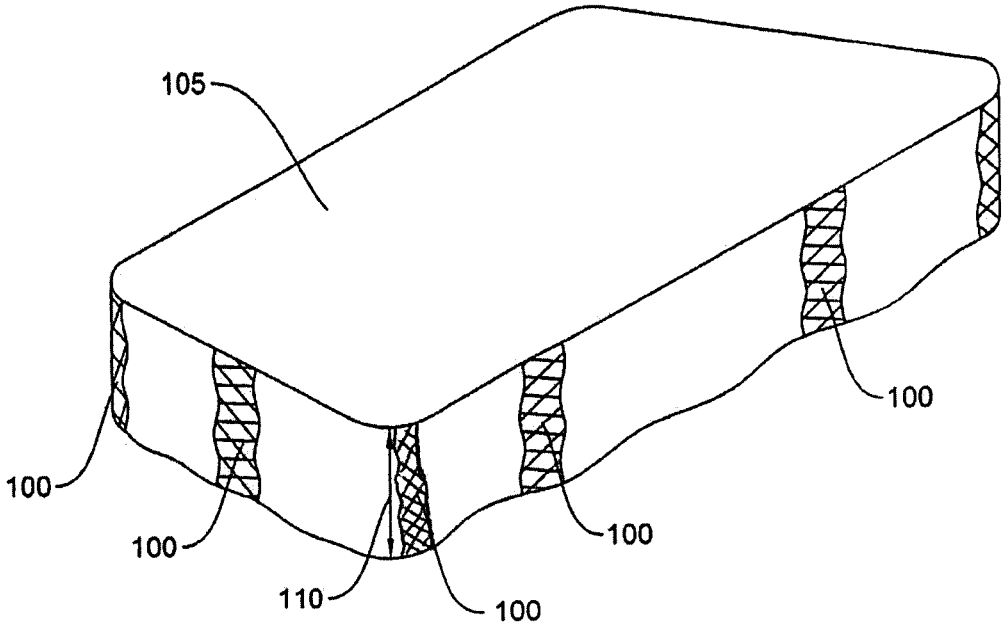
FIG. 10B and is a perspective view of a sheet having the multiple power bands; and Like reference numerals indicate similar parts throughout the figures.

In one embodiment, sheets having power bands are shown in FIGS. 10, 10A and 10B. As shown in FIG. 10 power band 100 is used as part of a sheet 105 to keep the sheet on a mattress. In particular, the power band 100 is part of or comprises the entire drop portion 110 of the sheet 105. The power band 100 can extend around the entire drop portion 110 of the sheet, in strategically located sections of the sheet as wide or narrow stripes. In one embodiment as shown in FIG. 10A, the drop portion 110 of the sheet 105 includes two power bands 100 and 100A. The power bands 100 and 100A are horizontally spaced apart from one another. In one embodiment the power band 100 is positioned between a top edge and a bottom edge of the drop portion of the sheet and a second power band is horizontally spaced apart from the first power band and is positioned along the lower edge of the drop portion of the sheet. Other orientations of the power bands are also possible and fall within the spirit of the present disclosure. The power bands 100 and 100A are each planar strips of material having the elastic and sheen properties discussed herein. In some embodiments, power bands 100 extend parallel to one another on the sheet 105 as shown in FIG. 10A. In some embodiments, power bands 100 may be disposed at alternate orientations, relative to one another, such as, for example, transverse, perpendicular and/or other angular orientations such as acute or obtuse, and/or may be offset or staggered along the drop portion of the sheet as shown in FIG. 10B.

Figure 8:
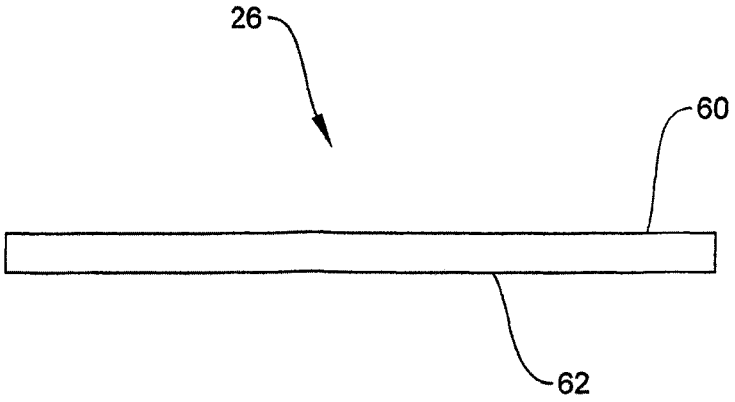
FIG. 8 is a side view of a component of the bedding system shown in FIG. 1.

In some embodiments, at least one of power bands 26 comprises an iridescent yarn to provide a sheen. In some embodiments, at least one of power bands 26 comprises a top surface 60 and an opposite bottom surface 62, as shown in FIG. 8. In some embodiments, top surface 60 comprises an iridescent yarn to provide sheen and bottom surface 62 defines a textured surface. In some embodiments, top surface 60 comprises an iridescent yarn to provide sheen and is smooth and bottom surface 62 defines a textured surface. In some embodiments, the textured surface comprises silicone, rubber, etc. that is coated onto or otherwise applied to a material that includes nylon, polyester and spandex.

In some embodiments, at least one of power bands 26 comprises a material having a weight per meter of between about 10G and about 30G. In some embodiments, at least one of power bands 26 comprises a material having a weight per meter of between about 20G and about 35G. In some embodiments, at least one of power bands 26 comprises a material having a weight per meter of 23.25 G. In some embodiments, at least one of power bands 26 comprises a material having a weight per meter of 20.1 G.

In some embodiments, at least one of power bands 26 comprises a material having a dimensional stability of between about 0% and about −10%. In some embodiments, at least one of power bands 26 comprises a material having a dimensional stability of between about −2.5% and about −7.5%. In some embodiments, at least one of power bands 26 comprises a material having a dimensional stability of −5%.

In some embodiments, at least one of power bands 26 comprises a woven material. In some embodiments, at least one of power bands 26 comprises a reinforced jacquard knit fabric. In some embodiments, at least one of power bands 26 comprises an elastic material include a class of polymer materials with high elastic nature including but not limited to natural rubber, synthetic rubber, nitrile rubber, silicone rubber, urethane rubbers, chloroprene rubber, Ethylene Vinyl Acetate (EVA rubber), nylon, polyester and spandex and combinations thereof.

In some embodiments, at least one of power bands 26 comprises nylon, polyester and spandex can be woven, layered, knitted and further processed to create at least a portion of the powerband. Once crated the powerband may undergo additional processing and finishing steps including heat, coating, brushing and other finishing processes that produces the sheen. In some embodiments, at least one of power bands 26 comprises between about 40% and about 80% nylon, between about 10% and about 30% polyester and between about 5% and about 25% spandex. In some embodiments, at least one of power bands 26 comprises between about 50% and about 70% nylon, between about 15% and about 25% polyester and between about 10% and about 20% spandex. In some embodiments, at least one of power bands 26 comprises between about 60% and about 70% nylon, between about 15% and about 20% polyester and between about 10% and about 20% spandex. In some embodiments, at least one of power bands 26 comprises about 64% nylon, about 19.1% polyester and about 16.9% spandex. In some embodiments, at least one of power bands 26 comprises about 63% nylon, about 19% polyester and about 18% spandex. In some embodiments, at least one of power bands 26 comprises about 63% nylon, about 18.8% polyester and about 18.2% spandex. In some embodiments, at least one of power bands 26 comprises about 64.6% nylon, about 19% polyester and about 15.7% spandex. In some embodiments, the polyester comprises 100D/36F polyester. In some embodiments, the spandex comprises 840 spandex and other similar elastic materials. In some embodiments, the nylon comprises 140/48F nylon as well as other nylon types.

In some embodiments, at least one of power bands 26 comprises polyester and latex. In some embodiments, at least one of power bands 26 comprises between about 1% and about 50% latex and between about 50% and about 99% polyester. In some embodiments, at least one of power bands 26 comprises between about 15% and about 40% latex and between about 60% and about 85% polyester. In some embodiments, at least one of power bands 26 comprises between about 20% and about 30% latex and between about 70% and about 80% polyester. In some embodiments, at least one of power bands 26 comprises 26% latex and 74% polyester.

In some embodiments, at least one of power bands 26 comprises polyester having a Denier (D) between about 100D and about 200D and yarn size containing between about 30 filaments and about 60 filaments. In some embodiments, at least one of power bands 26 comprises polyester having a Denier (D) between about 125D and about 175D and yarn size containing between about 40 filaments and about 50 filaments. In some embodiments, at least one of power bands 26 comprises polyester having a 175 Denier and yarn size containing 48 filaments.

In some embodiments, at least one of power bands 26 comprises a material having an elongation of about 100% to about 200% at a load of 5.25 kgf. In some embodiments, at least one of power bands 26 comprises a material having an elongation of about 125% to about 175% at a load of 5.25 kgf. In some embodiments, at least one of power bands 26 comprises a material having an elongation of 150% at a load of 5.25 kgf.

In some embodiments, at least one of power bands 26 comprises a material having an elongation of about 80% to about 160% at a load of 100 Newtons (N). In some embodiments, at least one of power bands 26 comprises a material having an elongation of about 100% to about 140% at a load of 100N. In some embodiments, at least one of power bands 26 comprises a material having an elongation of about 110% to about 130% at a load of 100N. In some embodiments, at least one of power bands 26 comprises a material having an elongation of about 118% at a load of 100N. In some embodiments, at least one of power bands 26 comprises a material having an elongation of about 120.7% at a load of 100N. In some embodiments, the elongation of the material was determined using ASTM D4964-96 (2016) wherein the specimen size was 250 mm in loop length and the machine speed was 500 mm/min. The specimen in loop form was placed around clamps of the testing machine, which then undergoes a longitudinal pull. Cycling three times from zero to 100N load was performed. The percent elongation at 100 N load and the tension at 30%, 50% and 70% elongation was recorded from the third extension-load curve.

In some embodiments, at least one of power bands 26 comprises a material having tension at 30% elongation of between about 0.1 lbf and about 20 lbf. In some embodiments, at least one of the power bands comprises a material having tension at 30% elongation of 16 lbf. In some embodiments, at least one of power bands 26 comprises a material having tension at 30% elongation of between about 2.5 lbf and about 4.5 lbf. In some embodiments, at least one of power bands 26 comprises a material having tension at 30% elongation of 3.5 lbf. In some embodiments, the elongation of the material was determined using ASTM D4964-96 (2016) wherein the specimen size was 250 mm in loop length and the machine speed was 500 mm/min. The specimen in loop form was placed around clamps of the testing machine, which then undergoes a longitudinal pull. Cycling three times from zero to 100N load was performed. The percent elongation at 100 N load and the tension at 30%, 50% and 70% elongation was recorded from the third extension-load curve.

In some embodiments, at least one of power bands 26 comprises a material having tension at 50% elongation of between about 0.1 lbf and about 30 lbf. In some embodiments, at least one of power bands 26 comprises a material having tension at 50% elongation of between about 1 lbf and about 40 lbf. In some embodiments, at least one of power bands 26 comprises a material having tension at 50% elongation of 22 lbf. In some embodiments, at least one of power bands 26 comprises a material having tension at 50% elongation of between about 3 lbf and about 7 lbf. In some embodiments, at least one of power bands 26 comprises a material having tension at 50% elongation of between about 5.2 lbf. In some embodiments, the elongation of the material was determined using ASTM D4964-96 (2016) wherein the specimen size was 250 mm in loop length and the machine speed was 500 mm/min. The specimen in loop form was placed around clamps of the testing machine, which then undergoes a longitudinal pull. Cycling three times from zero to 100N load was performed. The percent elongation at 100 N load and the tension at 30%, 50% and 70% elongation was recorded from the third extension-load curve.

In some embodiments, at least one of power bands 26 comprises a material having tension at 70% elongation of between about 0.1 lbf and about 50 lbf. In some embodiments, at least one of power bands 26 comprises a material having tension at 70% elongation of 29 lbf. In some embodiments, at least one of power bands 26 comprises a material having tension at 70% elongation of between about 1 lbf and about 13 lbf. In some embodiments, at least one of power bands 26 comprises a material having tension at 70% elongation of between about 3 lbf and about 11 lbf. In some embodiments, at least one of power bands 26 comprises a material having tension at 70% elongation of between about 5 lbf and about 9 lbf. In some embodiments, at least one of power bands 26 comprises a material having tension at 70% elongation of between about 6 lbf and about 8 lbf. In some embodiments, at least one of power bands 26 comprises a material having tension at 70% elongation of between about 7.2 lbf. In some embodiments, the elongation of the material was determined using ASTM D4964-96 (2016) wherein the specimen size was 250 mm in loop length and the machine speed was 500 mm/min. The specimen in loop form was placed around clamps of the testing machine, which then undergoes a longitudinal pull. Cycling three times from zero to 100N load was performed. The percent elongation at 100 N load and the tension at 30%, 50% and 70% elongation was recorded from the third extension-load curve.

In some embodiments, at least one of power bands 26 comprises a material having a recovery at maximum tension of between about 75% and about 99% after 1 minute. In some embodiments, at least one of power bands 26 comprises a material having at maximum tension of between about 85% and about 95% after 1 minute. In some embodiments, at least one of power bands 26 comprises a material having at maximum tension of 93.5% after 1 minute. In some embodiments, the recovery of the material was determined using ASTM D4964-96.

In some embodiments, at least one of power bands 26 comprises a material having a recovery at maximum tension of between about 75% and about 99% after 30 minutes. In some embodiments, at least one of power bands 26 comprises a material having at maximum tension of between about 85% and about 95% after 30 minutes. In some embodiments, at least one of power bands 26 comprises a material having at maximum tension of 94.8% after 30 minutes. In some embodiments, the recovery of the material was determined using ASTM D4964-96.

In some embodiments, at least one of power bands 26 comprises a material having a recovery at maximum tension of between about 75% and about 99% after 60 minutes. In some embodiments, at least one of power bands 26 comprises a material having at maximum tension of between about 85% and about 95% after 60 minutes. In some embodiments, at least one of power bands 26 comprises a material having at maximum tension of 94.8% after 60 minutes. In some embodiments, the recovery of the material was determined using ASTM D4964-96.

In some embodiments, at least one of power bands 26 comprises a material having between about 100 and about 400 warp threads per unit length. In some embodiments, at least one of power bands 26 comprises a material having between about 200 and about 350 warp threads per unit length. In some embodiments, at least one of power bands 26 comprises a material having between about 275 and about 325 warp threads per unit length. In some embodiments, at least one of power bands 26 comprises a material having about 297 warp threads per unit length. In some embodiments, the warp threads per unit length was determined using ASTM D3775-12.

In some embodiments, at least one of power bands 26 comprises a material having between about 1 and about 250 weft threads per inch. In some embodiments, at least one of power bands 26 comprises a material having between about 50 and about 200 weft threads per inch. In some embodiments, at least one of power bands 26 comprises a material having between about 100 and about 170 weft threads per inch. In some embodiments, at least one of power bands 26 comprises a material having between about 135 weft threads per inch. In some embodiments, the weft threads per inch was determined using ASTM D3775-12.

In some embodiments, at least one of power bands 26 comprises a material having between about 1 and about 100 weft threads per centimeter. In some embodiments, at least one of power bands 26 comprises a material having between about 10 and about 90 weft threads per centimeter. In some embodiments, at least one of power bands 26 comprises a material having between about 30 and about 80 weft threads per centimeter. In some embodiments, at least one of power bands 26 comprises a material having between about 53 weft threads per centimeter. In some embodiments, the weft threads per centimeter was determined using ASTM D3775-12.

In some embodiments, at least one of power bands 26 comprises a material having a weight per linear meter between about 1 g/m and about 40 g/m. In some embodiments, at least one of power bands 26 comprises a material having a weight per linear meter between about 5 g/m and about 35 g/m. In some embodiments, at least one of power bands 26 comprises a material having a weight per linear meter between about 10 g/m and about 30 g/m. In some embodiments, at least one of power bands 26 comprises a material having a weight per linear meter between about 15 g/m and about 25 g/m. In some embodiments, at least one of power bands 26 comprises a material having a weight per linear meter between about 19.8 g/m. In some embodiments, the weight per linear meter was determined using ASTM D1059-2001.

Figure 9:
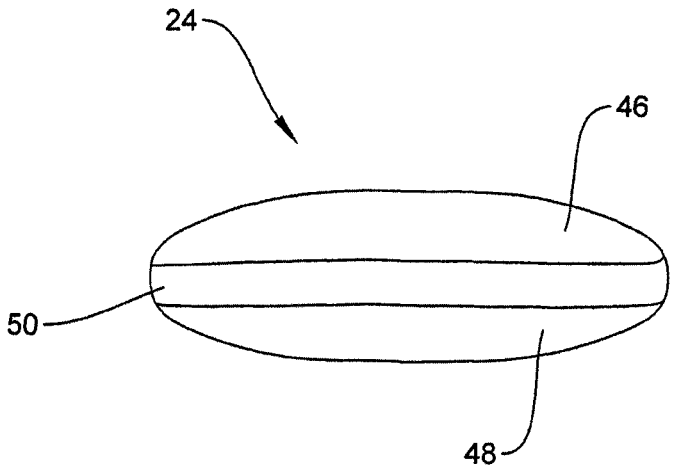
FIG. 9 is a side view of one embodiment of a component of the system shown in FIG. 1, in accordance with the principles of the present disclosure.

In one embodiment, shown in FIG. 9, pillow 24 includes a first panel 46, an opposite second panel 48 and a gusset 50 that joins panels 46, 48. Gusset 50 is configured to allow air that enters a cavity of pillow 24 though panel 46 and/or panel 48 to exit the cavity through gusset 50. Gusset 50 extends continuously around entire perimeters of panels 46, 48 to space panel 46 apart from panel 48. In some embodiments, panels 46, 48 are each made a first material and gusset 50 is made from a second material that is different than the first material. In some embodiments, the first material is a breathable fabric. In some embodiments, the second material has a porosity that is greater than a porosity of the first material. In some embodiments, pillow 24 has a rectangular footprint. In some embodiments, pillow 24 includes a fill material positioned within the cavity of pillow 24 that provides pillow 24 with a rectangular footprint.

In some embodiments, panel 28 and/or panel 30 comprises an inelastic material. In some embodiments, panel 28 and/or panel 30 comprises a performance fabric. In some embodiments, the performance fabric is warp knitted. In some embodiments, the performance fabric is warp knitted and includes many yarns that are knit to together, as opposed to one yarn knit to the end. In some embodiments, the performance fabric is produced by circular knitting. In some embodiments, the circular knitting process includes circularly knitting yarn or other material into a fabric, such as, for example, a performance fabric. Circular knitting may include organizing knitting needles into a circular knitting bed. The knitting needles produce a circular fabric that is in a tubular form through the center of the cylinder.

In some embodiments, the performance fabric is a 100% polyester knit jersey cotton fabric. In some embodiments, the performance fabric includes a single layer. In some embodiments, the performance fabric includes a plurality of layers. In some embodiments, the performance fabric includes three layers, such as, for example, a top layer, a bottom layer and a middle layer between the top and bottom layers. In some embodiments, the bottom layer is a flat layer. In some embodiments, the bottom layer is a flat layer that contains more than 500 yarns. In some embodiments, the middle layer is a kind of filling that links the top and bottom layers. In some embodiments, the top layer is less dense than the bottom layer. In some embodiments, the top layer includes less yarns than the bottom layer. In some embodiments, the top layer has about 375 yarns. In some embodiments, the performance fabric comprises a material selected from a group consisting of acrylic, acetate, cotton, linen, silk, polyester, other polymers, wool, nylon, rayon, spandex, lycra, hemp, manmade materials, natural materials and blends or combinations thereof.

In some embodiments, pillowcase 22 is made from a performance fabric that allows heat and moisture that radiates from the sleeper's head and/or body to dissipate through pillowcase 22. In some embodiments, the performance fabric is a knitted fabric, including, but not limited to, a warp knitted performance fabric, a weft knitted performance fabric and a circular knitted performance fabric. In some embodiments, the performance fabric is a circular knitted performance fabric having a plurality of spaced apart ventilation ports. The circular knitted performance fabric has a gauge per square inch, grams per square meter, air permeability and material content that are pre-selected to provide the circular knitted performance fabric with one or more selected physical features. In some embodiments, the material is one or more of the materials discussed in U.S. patent application Ser. No. 15/141,223, which is incorporated herein by reference, in its entirety.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A pillowcase comprising:

a top panel;

an opposite bottom panel, the top panel having three sides that are joined with three sides of the bottom panel such that inner surfaces of the top and bottom panels that face one another define a cavity configured for disposal of a pillow, fourth sides of the top and bottom panels are not joined with one another and define an opening that is in communication with the cavity; and a power band that extends across the opening such that a first end of the power band is permanently coupled to the top panel and an opposite second end of the power band is permanently coupled to the bottom panel, the power band including a sheen.

2. A pillowcase as recited in claim 1, wherein the power band comprises an iridescent yarn to provide the sheen.

3. A pillowcase as recited in claim 1, wherein the power band comprises a top surface and an opposite bottom surface, the top surface comprising an iridescent yarn to provide the sheen, the bottom surface defining a textured surface.

4. A pillowcase as recited in claim 1, wherein the power band comprises a top surface an opposite bottom surface, the top surface comprising an iridescent yarn to provide the sheen, the top surface being smooth, the bottom surface defining a textured surface.

5. A pillowcase as recited in claim 1, wherein the power band comprises a reinforced jacquard knit fabric.

6. A pillowcase as recited in claim 1, wherein the power band comprises a material having a weight per meter of between about 10G and about 30G.

7. A pillowcase as recited in claim 1, wherein the power band comprises a material having a weight per meter of between about 20G and about 35G.

8. A pillowcase as recited in claim 1, wherein the panels are free of any flaps that extend from the fourth side of the top panel or the fourth side of the bottom panel.

9. A pillowcase as recited in claim 1, wherein the power band comprises a material having a dimensional stability of between about 0% and about −10%.

10. A pillowcase as recited in claim 1, wherein the power band comprises a material having a dimensional stability of between about −2.5% and about −7.5%.

11. A pillowcase as recited in claim 1, wherein the top panel is identical to the bottom panel.

12. A pillowcase as recited in claim 1, wherein the power band comprises polyester and latex.

13. A pillowcase as recited in claim 1, wherein the power band comprises between about 1% and about 50% latex and between about 50% and about 99% polyester.

14. A pillowcase as recited in claim 1, wherein the power band comprises between about 15% and about 40% latex and between about 60% and about 85% polyester.

15. A pillowcase as recited in claim 1, wherein the power band comprises between about 20% and about 30% latex and between about 70% and about 80% polyester.

16. A pillowcase as recited in claim 1, wherein the pillow has a maximum length defined by lengths of the panels and a maximum width defined by widths of the panels.

17. A pillowcase as recited in claim 1, wherein the power band comprises polyester having a Denier (D) between about 100D and about 200D and yarn size containing between about 30 filaments and about 60 filaments.

18. A pillowcase as recited in claim 1, wherein the power band comprises polyester having a Denier (D) between about 125D and about 175D and yarn size containing between about 40 filaments and about 50 filaments.

19. A pillowcase as recited in claim 1, wherein edges of the fourth sides define a perimeter, the perimeter defining the opening, the perimeter being free of elastic material.

20. A pillowcase as recited in claim 1, wherein the power band comprises a material having an elongation of about 100% to about 200% at a load of 5.25 kgf.

* * * * *